US009242165B2

(12) United States Patent
Maier

(10) Patent No.: US 9,242,165 B2
(45) Date of Patent: Jan. 26, 2016

(54) CYCLING SUIT WITH A SEAT PAD AND A METHOD FOR MAKING THE SAME

(71) Applicant: ASSOS OF SWITZERLAND S.A., San Pietro di Stabio (CH)

(72) Inventor: Roger Maier, Carona (CH)

(73) Assignee: ASSOS OF SWITZERLAND S.A., San Pietro Di Stabio (CH)

( * ) Notice: Subject to any disclaimer, the term of this patent is extended or adjusted under 35 U.S.C. 154(b) by 0 days.

(21) Appl. No.: 14/552,838

(22) Filed: Nov. 25, 2014

(65) Prior Publication Data

US 2015/0151184 A1 Jun. 4, 2015

(30) Foreign Application Priority Data

Nov. 29, 2013 (EP) ..... 13195006

(51) Int. Cl.
*A63B 71/12* (2006.01)
*A41D 1/08* (2006.01)
*A41D 13/05* (2006.01)

(52) U.S. Cl.
CPC ..... *A63B 71/1216* (2013.01); *A41D 1/084* (2013.01); *A41D 13/0525* (2013.01)

(58) Field of Classification Search
CPC ..... A63B 71/1216; A41D 13/02; A41D 1/06; A41D 1/08; A41D 15/02; A41B 9/02; A41B 9/04
USPC ..... 2/466, 79, 227, 238, 404, 407, 214, 2/78.2
See application file for complete search history.

(56) References Cited

U.S. PATENT DOCUMENTS

| | | | | |
|---|---|---|---|---|
| 1,512,171 | A * | 10/1924 | Homling | 2/78.2 |
| 2,215,291 | A * | 9/1940 | Hurd | 2/78.2 |
| 2,682,661 | A * | 7/1954 | Kessler | 2/78.2 |
| 4,035,844 | A * | 7/1977 | Atack et al. | 2/466 |
| 4,805,243 | A * | 2/1989 | Gibbens et al. | 2/228 |
| 4,961,233 | A * | 10/1990 | Black | 2/228 |
| 5,271,101 | A * | 12/1993 | Speth et al. | 2/228 |
| 8,087,097 | B2 * | 1/2012 | Maier | 2/227 |
| 2007/0294803 | A1 | 12/2007 | Furgerson et al. | |

FOREIGN PATENT DOCUMENTS

EP 1834532 A1 9/2007

OTHER PUBLICATIONS

European Search Report mailed on Mar. 19, 2014 in European Application No. 13195006. (2 pages).

* cited by examiner

*Primary Examiner* — Tejash Patel
(74) *Attorney, Agent, or Firm* — Novak Druce Connolly Bove + Quigg LLP

(57) ABSTRACT

A cycling suit (1) comprising a seat pad (2) in the crotch area, wherein the cycling suit comprises a plurality of fabric panels, which are associated along structural seams, and the seat pad is attached by means of a front panel (8) which is fixed to the suit along structural seams (11-15) of the same; a corresponding method for manufacturing the cycling suit is also described.

9 Claims, 2 Drawing Sheets

CYCLING SUIT WITH A SEAT PAD AND A METHOD FOR MAKING THE SAME

CROSS REFERENCE TO RELATED APPLICATIONS

This US Application claims priority to European Application No.:13195006.5, filed Nov. 29, 2013, entitled "A CYCLING SUIT WITH A SEAT PAD AND A METHOD FOR MAKING THE SAME" the entirety of which is incorporated herein by reference.

FIELD OF THE INVENTION

The invention relates to the field of cycling sport suits including a seat pad in the crotch area. More in particular, the invention relates to the front junction between the seat pad and the suit.

PRIOR ART

Cycling suits including a seat pad are well known in the art. A known structure of a cycling suit includes a plurality of fabric portions, which are also termed panels, connected each other by suitable seams, as described for example in EP-A-1834532.

The seat pad usually comprises a soft fabric piece, which is also termed cover, and a padding. The padding is normally in the form of two or more shaped pads fixed to said cover or, less frequently, to the cycling suit. The cover normally includes multiple layers, for example a soft expanded material sandwiched between two fabric layers.

In the prior art, the seat pad is directly fixed to the suit. The edge of said cover, or at least a part thereof, is for example stitched, glued or welded to the cycling suit. Known improvements to this technique include: EP 1430797 disclosing that the lining of a seat pad is attached to cycling shorts at selected points along the edge of the lining, and EP 2494878 disclosing that a seat pad is attached at front and rear attachment regions, leaving a loose central portion.

The crotch area of the suit, and the seam between the seat pad and the suit, are of crucial importance in a cycling garment, especially when designed for high performance. The crotch area of the suit undergoes a relevant mechanical stress due to pedaling, and especially the connection between the seat pad and the suit is a most stressed point of the suit.

Further to the above, the front portion of the crotch area is directly exposed to air and wind, and is also a region of intense sweating. It has also been noted that the interface between the front portion of the seat pad and the suit is important in terms of comfort for the user.

Accordingly, an aim of the invention is to further ameliorate the prior art, and in particular the front connection between the seat pad and the suit, taking the above problems into account.

SUMMARY OF THE INVENTION

In a cycling suit having the above mentioned structure, namely made of several fabric portions connected each other by perimeter seams, it is proposed to provide an additional front panel for fixation of the seat pad to the suit.

The aims of the invention are then reached with a cycling suit comprising a seat pad in the crotch area, and a plurality of fabric panels which are associated along structural seam lines, characterized in that:

the suit comprises a front connection panel for connection of a front part of said seat pad to the suit, said front connection panel being fixed to said front part of seat pad on at least a seam line, said front connection panel being also fixed to the suit along at least two of said structural seam lines.

Each one of said at least two structural seam lines connect together at least two of said fabric panels of the cycling suit, and also said front panel.

In this description and in the attached claims, the term of seam line, or seam, are used to denote any applicable technique for joining fabric panels, including for example sewing, gluing, welding. Preferably, the seam is made by sewing. The term of cycling suit is used to denote various items including at least a trouser portion having a crotch area, such as a bodysuit, a pair of trousers and the like.

The front connection panel is separate from the seat pad. Instead of fixing the front portion of the seat pad directly to the suit, the invention provides that the front of the seat pad is stitched or otherwise fixed by means of said front connection panel. The several advantages of this configuration are discussed below.

In a preferred embodiment, at least one fixation of said front panel to the suit includes an edge of the front panel folded over a structural seam of the suit, in such a way that the seam is covered by the edge of the panel itself. This feature provides some additional advantages, including more comfort and protection against sweat, which will be discussed hereinbelow in a greater detail.

Said front panel is preferably a fabric panel. It is preferably a single layer piece of fabric, while the cover of the seat pad preferably includes a plurality of layers, for example three layers including a foam expanded material sandwiched between two fabric layers.

Several other preferred features of the invention are stated in the dependent claims.

The advantages of the invention can be summarized as follows.

A first advantage is a smooth transition between the seat pad and the panels of the suit. Prior art cycling suits typically show a step along the boundary line between the seat pad and the suit. This step is a perceptible discontinuity and may cause discomfort under intensive use. The connection via the additional front panel, according to the invention, reduces or virtually eliminates this drawback.

A second advantage is that the additional front panel can be made with a specific material and/or with a specific finishing, to provide a better comfort. The additional front panel, in particular, may have higher features than the seat pad. The addition of the front panel may e.g. provide a distinctive element between a top-range cycling suits and a lower model. It should be noted that a better comfort in the lower abdominal part of the body is particularly appreciated by the users. In preferred embodiments, the additional front panel is made softer and/or lighter and/or more breathable than the seat pad.

A third advantage is a better protection and shielding from cold and wind, provided by the additional front panel which creates a double-layer protection. The lower abdomen is highly sensitive to the wind, especially in the cold season, which means that the additional protection of the invention is welcomed by the users. In accordance, the invention is particularly, but not exclusively, adapted for the manufacturing of a winter cycling suit.

A fourth advantage is a better distribution of the mechanical stress in the crotch area at the interface between the seat pad and the suit. The seam line between the additional front panel and the suit is longer than seam lines for direct fixation of the seat pad, as found in a conventional cycling suit, leading to a lower specific mechanical stress along the seam line itself.

A fifth advantage is a better protection against sweat. The fabric material of the front region of the suit is prevented from the attack of sweat by the shielding effect of the additional front panel.

Some embodiments of cycling suit, especially for the cold season, have a layered structure including an outer layer made of a suitable elastic synthetic fibre such as Lycra, and a windproof membrane facing the inside of the suit, that is facing the body of the user. Direct contact of the windproof membrane with the skin however may cause problems. Said membrane is primarily designed to stop the wind and not to provide the best possible comfort; furthermore the membrane may be damaged by the sweat. In particular, the membrane is generally not able to absorb sweat. It should be noted in this respect that the front crotch area is also a zone of intense sweating. In such cases, another advantage of the invention is the additional front panel preventing said windproof membrane from direct contact with the skin and avoiding the above drawbacks. Accordingly, some embodiments provide a soft front panel in contact with the skin for more comfort, and a windproof membrane which is suitably protected from the sweat.

The preferred embodiments including front panel edges folded over the seams have some additional advantages. First, the skin of the user is kept from a direct contact and friction with the seams, which may be a source of discomfort particularly in the crotch area where skin is highly sensitive; secondly, the seams are even better protected from the aggression of sweat.

An aspect of the invention is also a method for making a cycling suit, according to the attached claims.

The inventive method is advantageous in that the number of seams during the manufacturing process is reduced. It should be noted that, in most cases, the manufacturer of the cycling suit receives the seat pad from an external supplier, ready to insertion in the suit. According to the prior technique, the manufacturer of the cycling suit must perform separate seams to connect together the panels of the suit, and then to attach the seat pad. In contrast, the invention provides that the seat pad is supplied with the additional front panel and can be attached to the suit during the execution of the structural seams. Accordingly, the work of the manufacturer is reduced.

The features and the advantages of the invention will be further elucidated with the help of the following detailed description, which is given for indicative and not limiting purpose.

DETAILED DESCRIPTION

A cycling suit 1 includes a seat pad 2 in the crotch area. The cycling suit 1 is made of a suitable elastic fabric, such as Lycra, and may have different forms, such as a bodysuit, a pair of trousers, and others, according to various embodiments of the invention and the intended use.

The cycling suit 1 is made preferably with an elastic woven or knitted fabric, and comprises several fabric panels, joined together along suitable perimeter seams or equivalent.

Figure 1:
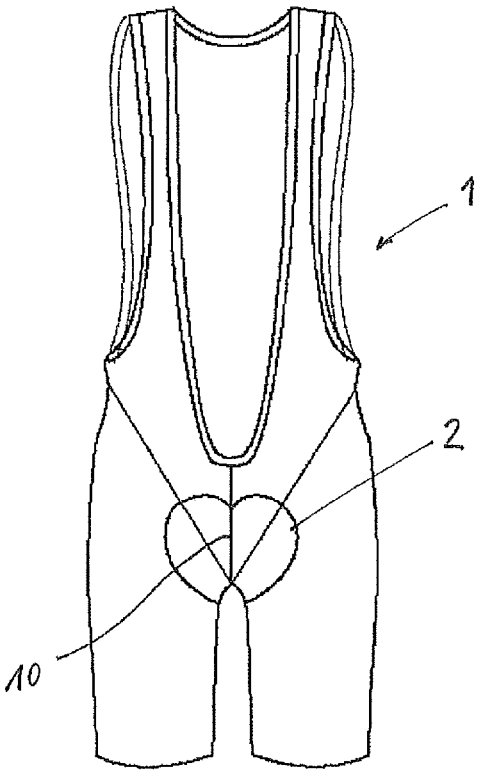
FIG. 1 is a view of a cycling suit according to an embodiment of the invention, comprising a seat pad in the crotch area.
Figure 2:
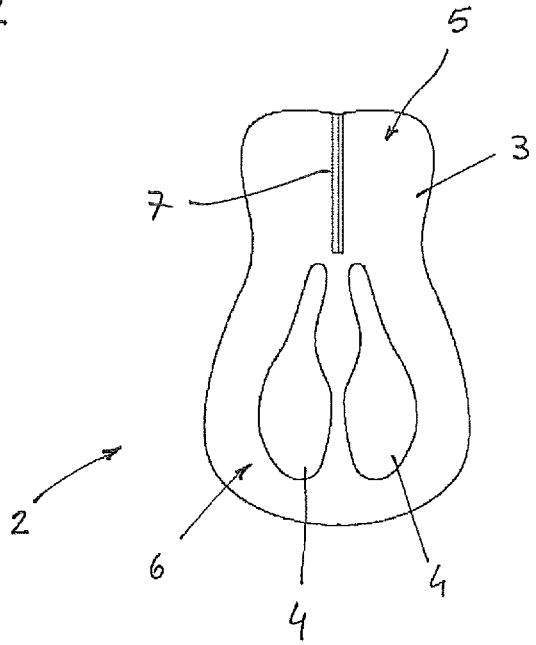
FIG. 2 is a top view of the seat pad of the cycling suit of FIG. 1.

The seat pad 2 includes a soft fabric piece to form a cover 3, and a suitable padding which for example includes a couple of pads 4. FIG. 2 illustrates and example of an anatomical shape of the seat pad 2, having a front portion 5 and a rear portion 6. The seat pad 2 has also a front longitudinal seam 7 which gives the pad a concave shell shape, as described e.g. in EP 1 972 216.

The front portion 5 of the seat pad 2 is attached to the suit 1 via an additional front panel 8. Said front panel 8, which is for example made of an elastic fibre such as Lycra, provides an integrated front protection of the seat pad 2.

Said additional panel 8 is fixed to the suit along at least two structural seam lines, e.g. a left structural seam line and a right structural seam line.

Figure 3:
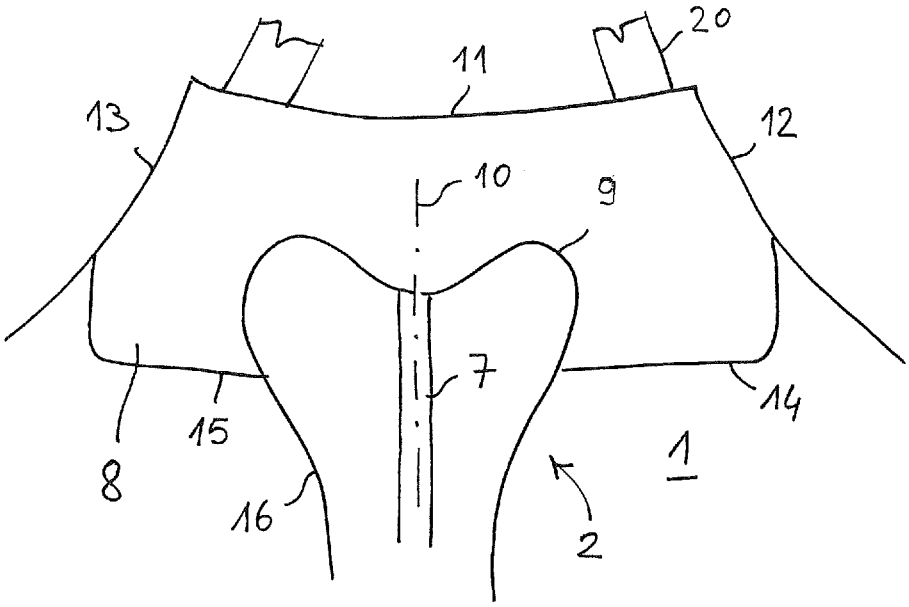
FIG. 3 is a detail of the connection between the seat pad and the cycling suit.

Referring to FIG. 3, said additional panel 8 is fixed to the front 5 of the seat pad 2 by a seam line 9, and is fixed to panels of the suit 1 by:

a front seam line 11;

upper left and right seam lines 12, 13;

lower left and right seam lines 14, 15.

Preferably, the front seam line 11 and the upper seam lines 12, 13 are made with a tape.

Each of said seam lines 11 to 15 is a line of connection between at least two of the panels of the suit 1.

The figure shows a preferred embodiment where the front and upper seams 11, 12, 13 are substantially arc-shaped and the lower seams 14, 15 are substantially L-shaped.

Preferably, as shown in FIG. 3, the panel 8 has a width greater than the width of the front portion 5 of the seat pad 2, in a direction of width which is perpendicular to a median crotch line 10 of the cycling suit 1. As a result, looking e.g. at FIG. 3, in can be appreciated that the seam lines between the panel 8 and the underlying suit are significantly longer than a conventional front seam between a seat pad and a suit. The stress induced by the pedaling action and transmitted to the suit 1 is distributed over a longer connection line and specific stress is reduced.

The central region of the seat pad, for example as denoted by reference 16 of FIG. 3, may be fixed to the suit or may be a loose bridge portion between the front and rear parts 5, 6 of the seat pad 2, as described in EP 2 494 878, according to different embodiments of the invention.

FIG. 3 also shows a pair of shoulder straps 20 of the suit 1.

Figure 4:
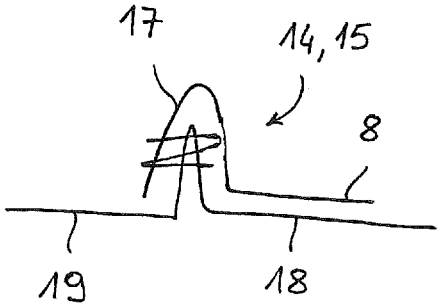
FIG. 4 is a scheme of a preferred embodiment for a junction between the seat pad and the cycling suit.

FIG. 4 shows a preferred embodiment of a connection between the panel 8 and underlying structural seams of the suit 1. This embodiment is preferably applied to the lower left and right seam lines 14, 15 of FIG. 3.

An edge portion 17 of the front panel 8 is folded over the structural seam 14 or 15 of the suit 1, which connects two panels of the suit 1. Said panels are denoted by references 18, 19 of FIG. 4. It can be seen that the seam line is covered by the edge 17 of the panel 8. Accordingly, the user is kept from direct contact with the seam, which may be a source of discomfort; furthermore, the panels 18, 19 and the seam itself are protected from direct attack of the sweat.

Another positive feature of the invention is the smoothness of seam line 9 (FIG. 3). In the prior art, the direct connection between the front of the seat pad and the suit forms a tactile discontinuity (step), which is unpleasant to most users. The invention solves also this problem thanks to the additional panel 8.

The invention claimed is:

1. A cycling suit (1) comprising a seat pad (2) in the crotch area, and a plurality of fabric panels which are associated along structural seam lines, characterized in that:

the suit (1) comprises a front connection panel (8) for connection of a front part (5) of said seat pad (2) to the suit (1), said front connection panel (8) being fixed to said front part (5) of seat pad (2) on at least a seam line (9), said front connection panel (8) being also fixed to the suit (1) along at least two of said structural seam lines (11-15).

2. The cycling suit according to claim 1, wherein an edge (17) of said front connection panel (8) is folded over at least one of said structural seam lines (11-15).

3. The cycling suit according to claim 1, wherein:

said front connection panel (8) is fixed to the suit by a front seam line (11), two upper left and right seam lines (12, 13) and two lower left and right seam lines (14, 15), and the fixation of the panel (8) to said two lower left and right seam lines (14, 15) is made by folding an edge (17) of the panel over said seam lines (14, 15).

4. The cycling suit according to claim 3, wherein:

said front seam line (11) and said upper left and right seam lines (12, 13) are substantially arc-shaped and said lower left and right seam lines (14, 15) are substantially L-shaped.

5. The cycling suit according to claim 1, said front connection panel (8) having a width greater than the width of the front portion (5) of the seat pad (2), in a direction of width which is perpendicular to a median crotch line (10).

6. The cycling suit according to claim 1, wherein said front connection panel (8) has a single fabric layer and a cover (3) of the seat pad (2) has a plurality of layers, preferably including foam expanded material sandwiched between two fabric layers.

7. The cycling suit according to claim 1, said front connection panel (8) being of a material softer than said seat pad.

8. The cycling suit according to claim 1, said front connection panel (8) being of a material lighter and more breathable than said seat pad.

9. A method for making a cycling suit (1) comprising a seat pad (2) in the crotch area, wherein the cycling suit is made of a plurality of fabric panels, which are associated along structural seam lines, the method comprising:

attaching a connection panel (8) to a front part (5) of the seat pad (2), attaching said front connection panel (8) to the suit (1) during the making of at least two of said structural seam lines (14, 15), connecting together said at least two fabric panels of the cycling suit (1) and said front connection panel (8).

* * * * *